United States Patent [19]

Seynhaeve

[11] Patent Number: 4,844,257

[45] Date of Patent: Jul. 4, 1989

[54] COAT-HANGER CARRIER, ESPECIALLY FOR CLOTHES-CARRYING LUGGAGE AND LUGGAGE COMPRISING SUCH A HANGER

[75] Inventor: Andreé G. Seynhaeve, Senlis, France

[73] Assignee: Delsey, France

[21] Appl. No.: 169,443

[22] Filed: Mar. 17, 1988

[30] Foreign Application Priority Data

Mar. 20, 1987 [FR] France ..... 87 03873

[51] Int. Cl.[4] ..... B65D 85/18; A45C 5/12

[52] U.S. Cl. ..... 206/279; 206/291; 211/124

[58] Field of Search ..... 206/279, 291; 211/124

[56] References Cited

U.S. PATENT DOCUMENTS 4,732,270 3/1988 Myers et al. ..... 206/291 X 4,753,342 6/1988 Pulichino, Jr. et al. ..... 206/291

FOREIGN PATENT DOCUMENTS 2949339 6/1981 Fed. Rep. of Germany ..... 206/279

*Primary Examiner*—William Price

*Attorney, Agent, or Firm*—James Creighton Wray

[57] ABSTRACT

This invention relates to a coat-hanger carrier, especially for an item or clothes-carrying luggage, of the type comprising a longitudinal bar, on which transverse coat-hangers are held, with means for disengaging said coat-hangers.

The coat-hanger carrier according to this invention is characterized by the fact that said bar for supporting the coat-hangers is surmounted by a block of elastic material, pivoting about an axis parallel to said bar and equipped with transverse slots forming elastic teeth locked onto said bar in a closed position.

5 Claims, 1 Drawing Sheet

COAT-HANGER CARRIER, ESPECIALLY FOR CLOTHES-CARRYING LUGGAGE AND LUGGAGE COMPRISING SUCH A HANGER

BACKGROUND TO THE INVENTION

This invention relates to a coat-hanger carrier, especially for an item of clothes-carrying luggage, of the type comprising a longitudinal bar, on which transverse coat-hangers are held, with means for disengaging said coat-hangers.

STATEMENT OF PRIOR ART

In U.S. Pat. No. 1,948,019, a coat-hanger carrier of this type comprises a fixed hanging bar and a locking bar articulated onto the former by a transverse axis. The device is difficult to use, because the locking bar must be capable of being opened, which requires a considerable amount of room. U.S. Pat. No. 3,566,456 arranges for the two bars forming a pincers to be equipped with elastic means, which does not improve the previous system.

In the U.S. Pat. Nos. 4,252,220 and 4,363,388, the arms of the pincers are articulated about a horizontal axis, whereas the preceding solutions provided a vertical axis. Although a large space is not required for opening the pincers, as before, it is necessary to provide a very rigid arresting means for the movable bar, because it carries the coat-hangers with the clothes.

In all these cases, in addition to the disadvantages in use indicated, the coat-hanger carriers cannot be used for different types of coat-hangers and are of relatively complicated and expensive construction.

OBJECT OF THE INVENTION

An object of the present invention is to provide a new coat-hanger carrier, of simple and economic design, capable of being easily used and permitting the use of widely different types of coat-hanger.

SUMMARY OF THE INVENTION

For this purpose, the coat-hanger carrier according to this invention is characterized by the fact that said support bar for the coat-hangers is surmounted by a block of elastic material, pivoting about an axis parallel to said bar and equipped with transverse slots which form elastic teeth locked onto said bar when in the closed position.

A simple rotation of the block releases the coat-hangers, which can then be lifted off the supporting bar.

BRIEF DESCRIPTION OF DRAWINGS

The invention will be better understood from reading the following description of an example of embodiment thereof, with reference to the attached drawing, in which.

DESCRIPTION OF PREFERRED EMBODIMENT

Figures 1, 2:
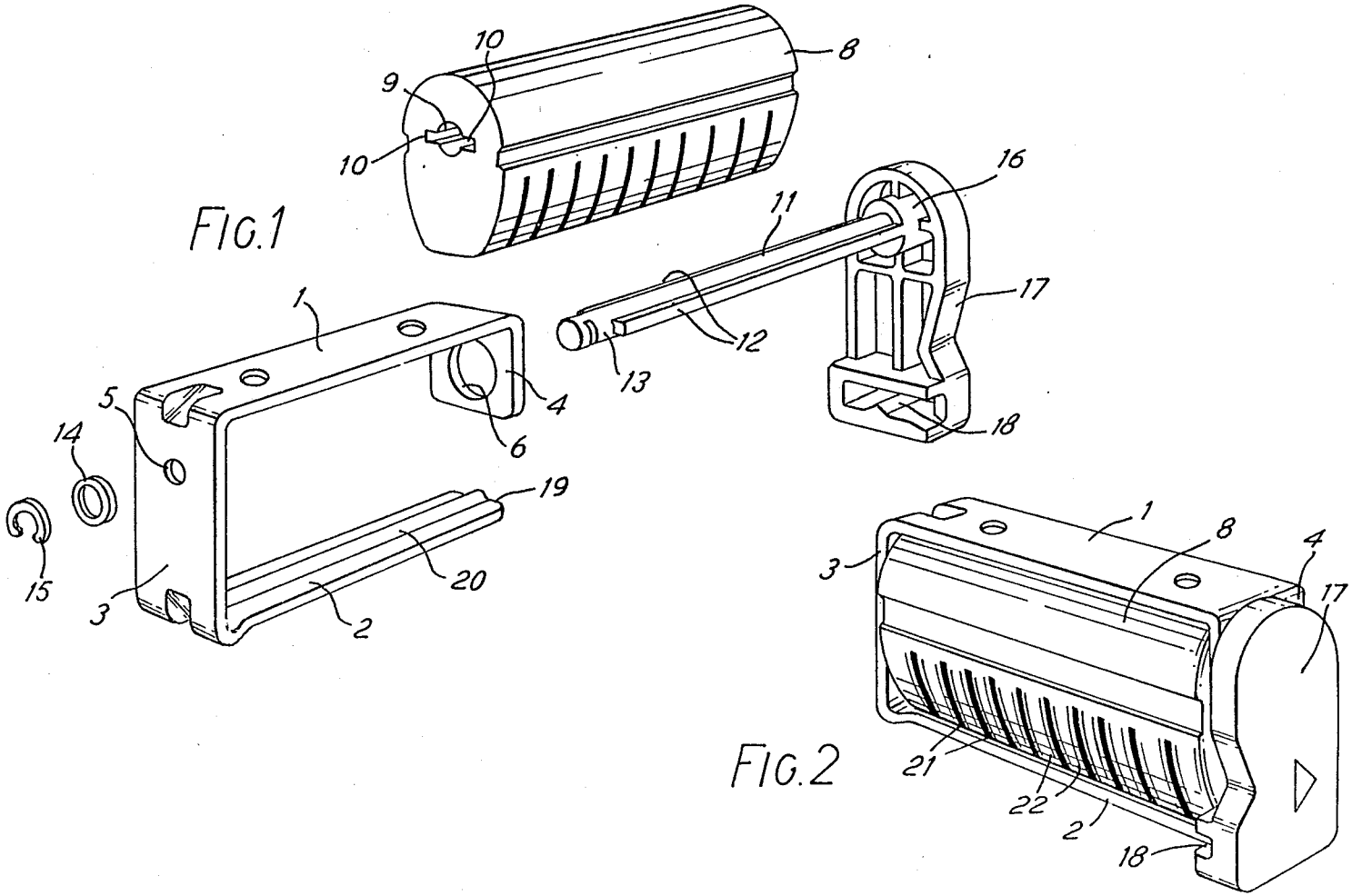
FIG. 1 is an exploded, perspective view of the coat-hanger carrier.
FIG. 2 is a perspective view of the coat-hanger carrier of FIG. 1, in the assembled state.

The coat-hanger carrier is composed of a cross-bar, formed of an upper plate 1 fixed transversely to the clothes-carrying luggage item (not shown) and connected to a hanging bar 2 for the coat-hangers by a vertical wall 3. Parallel to the wall 3, the plate 1 is continued by a return 4. The wall 3 comprises a hole 5 and the return 4 of a hole 6 of larger diameter, the holes 5 and 6 being coaxial with a horizontal longitudinal axis 7.

A block 8 of elastic material, such as rubber or plastics, is pivotally mounted between the plate 1 and the bar 2. The block 8 comprises a longitudinal passage 9, equipped with two flanges or wings 10, into which a shaft 11, equipped with flanges 12, of section corresponding to the passage 9–10 is threaded. One end 13 of the shaft 11 is locked in the hole 5 by a washer 14 and a circlip 15, whereas the other end of the shaft 11 is integrally connected with a cylindrical journal 16, rotatable in the hole 6.

The journal 16 forms part of an operating handle 17 seated outside the return 4 and adjacent to the latter. The handle 17 comprises a recess 18, cooperating with the free end 19 of the bar 2 for locking onto the latter. For this purpose, the bar 2 comprises a longitudinal rib 20, onto which the recess 18 of the handle 17 elastically locks and which, in addition, stiffens the bar 2.

The elastic block 8, in the locking position, bears against the rib 20. It comprises transverse slots 21, forming teeth 22 intended for separating and enclosing the coat-hangers in the closed position.

The bar 2, when the block 8 has been tilted by the handle 17 to disengage its end 19, may receive the curved part of coat-hangers of different thicknesses and depths. It may also receive, by forming a slide rail, conventionally known coat-hangers comprising a female profile mounted on the end of a pivoting hook.

I claim:

1. Coat-hanger carrier, comprising (a) a longitudinal bar on which transverse coat-hangers are held, (b) means for disengaging said coat-hangers, and (c) a block of elastic material surmounting said bar pivotable about an axis parallel to said bar and movable between free and closed positions, said block having transverse slots forming elastic teeth locked onto said bar in the closed position.

2. Coat-hanger carrier according to claim 1, wherein said block is mounted, fixed in rotation, on a shaft rotatable on a support of said bar and integral with an operating handle, wherein further the shaft is parallel to the bar.

3. Coat-hanger carrier according to claim 2, wherein said handle comprises a recess for snap-engagement onto a free end of said bar.

4. Coat-hanger carrier according to claim 1, wherein said bar comprises a longitudinal rib, onto which the block is in bearing in the closure position.

5. In an item of luggage, the improvement comprising a coat-hanger carrier arranged within said luggage, comprising a longitudinal bar on which transverse coat-hangers are held, means for disengaging said coat-hangers, and a block of elastic material surmounting said bar pivotable about an axis parallel to said bar and movable between free and closed positions, said block having transverse slots forming elastic teeth locked onto said bar in the closed position.

* * * * *